US010418196B2

(12) United States Patent
Larrieta Zubia et al.

(10) Patent No.: US 10,418,196 B2
(45) Date of Patent: Sep. 17, 2019

(54) ON-LOAD TAP CHANGER DEVICE

(71) Applicant: ORMAZABAL CORPORATE TECHNOLOGY, A.I.E., Amorebieta-Etxano (Bizkaia) (ES)

(72) Inventors: Javier Larrieta Zubia, Amorebieta-Etxana (ES); Severo Aranaga Lopez, Amorebieta-Etxana (ES); Luis Del Rio Etayo, Amorebieta-Etxana (ES); Jon Alcorta Goyenechea, Amorebieta-Etxana (ES)

(73) Assignee: Ormazabal Corporate Technology, A.I.E., Amorebieta-Etxano (Bizkaia) (ES)

( * ) Notice: Subject to any disclaimer, the term of this patent is extended or adjusted under 35 U.S.C. 154(b) by 137 days.

(21) Appl. No.: 15/568,686

(22) PCT Filed: Apr. 14, 2016

(86) PCT No.: PCT/ES2016/070261
§ 371 (c)(1),
(2) Date: Oct. 23, 2017

(87) PCT Pub. No.: WO2016/170211
PCT Pub. Date: Oct. 27, 2016

(65) Prior Publication Data

US 2018/0122591 A1 May 3, 2018

(30) Foreign Application Priority Data

Apr. 21, 2015 (EP) ..... 15382194

(51) Int. Cl.
*H01H 9/00* (2006.01)
*H01H 3/40* (2006.01)
*H01F 29/04* (2006.01)

(52) U.S. Cl.
CPC ..... *H01H 9/0016* (2013.01); *H01H 3/40* (2013.01); *H01H 9/0005* (2013.01);
(Continued)

(58) Field of Classification Search
CPC ..... H01H 3/32; H01H 3/40; H01H 9/005; H01H 9/0027; H01H 9/0033; H01H 2033/6668; H01F 29/04
See application file for complete search history.

(56) References Cited

U.S. PATENT DOCUMENTS 1,863,392 A 6/1932 Brand et al.
5,056,377 A 10/1991 Yatchum et al.
(Continued)

FOREIGN PATENT DOCUMENTS

BG 62108 B1 2/1999
DE 102012107080 B3 10/2013
(Continued)

OTHER PUBLICATIONS

Carević et al., Regulated Distribution Transformer, SO1-01, Croatian Liason Committee of the International Conference on Electricity Distribution, CIRED, May 2014.

*Primary Examiner* — Vanessa Girardi
(74) *Attorney, Agent, or Firm* — Knobbe, Martens, Olson & Bear, LLP

(57) ABSTRACT

The present invention relates to an on-load tap changer device, which allows the automatic regulation of voltage in the secondary winding (28) of high-voltage electrical equipment (26, 65) by selecting the number of turns of the primary winding (27) by means of an on-load tap changer device (1, 40), having reduced volume and weight, obtaining the highest possible number of transformation ratios without changing the constructive arrangement of the high-voltage electrical equipment (26, 65).

29 Claims, 14 Drawing Sheets

(52) U.S. Cl.
CPC ..... *H01H 9/0027* (2013.01); *H01H 9/0033* (2013.01); *H01H 9/0038* (2013.01); *H01H 9/0044* (2013.01); *H01F 29/04* (2013.01)

(56) References Cited

U.S. PATENT DOCUMENTS

| | | | | |
|---|---|---|---|---|
| 5,604,423 | A * | 2/1997 | Degeneff ..... | G05F 1/20 323/258 |
| 5,834,717 | A | 11/1998 | Neumeyer et al. | |
| 6,693,247 | B1 * | 2/2004 | Byers ..... | H01H 9/0027 200/11 TC |
| 9,269,508 | B2 * | 2/2016 | Reich ..... | H01F 29/02 |

FOREIGN PATENT DOCUMENTS

| | | | |
|---|---|---|---|
| JP | S5681915 | A | 7/1981 |
| JP | S5687307 | A | 7/1981 |
| JP | S6047405 | A | 3/1985 |
| JP | S60-91608 | A | 5/1985 |
| WO | 2012/175141 | A1 | 12/2012 |
| WO | 2013/156268 | A1 | 10/2013 |

* cited by examiner

ON-LOAD TAP CHANGER DEVICE

CROSS-REFERENCE TO RELATED APPLICATIONS

This application is the U.S. National Phase under 35. U.S.C. § 371 of International Application PCT/ES2016/070261, filed Apr. 14, 2016, which claims priority European Application No. 15382194.7, filed Apr. 21, 2015. The disclosures of the above-described applications are hereby incorporated by reference in their entirety.

OBJECT OF THE INVENTION

The present invention relates to the field of electric energy distribution and transformation, and more specifically to a "three-phase" or "single-phase" on-load tap changer device, applied in high-voltage electrical equipment, which allows selecting the number of turns of a primary winding to thus obtain the regulation of voltage in the secondary winding of the high-voltage electrical equipment. The object of the invention is to provide a compact tap changer device having reduced volume and weight which allows automatic voltage control.

BACKGROUND OF THE INVENTION

Keeping the output voltage of high-voltage electrical equipment, such as transformers, for example, within allowed or desired ranges depending on load circumstances has conventionally been done by means of changing the transformation ratio of said electrical equipment, such that the ratio between the voltages of the primary winding and of the secondary winding of said electrical equipment changes accordingly. To that end, the high-voltage electrical equipment is provided with a device called a tap changer, which can consist of an off-load or on-load tap changer, i.e., the changeover of taps can be done with the electrical equipment de-energized or energized. The tap changer device increases or reduces the number of turns of the primary winding, thereby changing the transformation ratio, or in other words changing the voltage in the secondary winding.

Use of the on-load tap changer device is common in electrical equipment, such as power transformers, for example, the service of which cannot be interrupted without seriously jeopardizing operation of the distribution system and with the subsequent nuisance for users of the distribution grid.

There are tap changer devices today, such as the one mentioned in patent document WO2013156268A1, for example, which discloses an on-load tap changer comprising switching means (vacuum interrupters) and tap selector means driven by a motor. These means are mounted vertically on a support plate, each of them on each side of the support plate, such that transmission of the action of the motor to said means is carried out by intermediate elements, such as a camshaft, a threaded spindle, sliding carriages, etc. These intermediate elements are mechanically linked with the switching means and tap selector means by means of linear motion, i.e., said elements transform rotational movement of the motor into linear movement to actuate the switching means and tap selector means.

The need for using all these intermediate elements involves the drawback of the volume the tap changer device adopts, and ultimately an increase in the dimensions of the transformer where the tap changer device is installed, which involves use of a larger volume of dielectric fluid, the increase in total weight of the transformer, the need for using an oil leakage sump having a larger dielectric fluid collecting capacity, etc. The dimensions of the transformer are also increased due to the design of the tap changer device, since this device comprises all the means and elements mounted on a vertically arranged longitudinal plate. Furthermore, given that the tap changer device is installed below the upper cover of the transformer, the height of the latter is increased, the transformer cavity where the tap changer device is mounted having to be filled with dielectric fluid.

On the other hand, in this solution of the state of the art the switching means are arranged linearly behind one another and vertically, the switching of which involves vibrations that are not compensated, thereby impairing the mechanical capabilities of the solution. Another example of a solution with the switching means arranged vertically is disclosed in US2014159847A1.

Some solutions with the switching means arranged equidistantly from one another at 120° on a horizontal plane are known. For example, solutions of this type are mentioned in patent documents JPS6091608 and JPS6047405. The solutions of patent documents JPS5687307 and JPS5681915, where the objective is to minimize the volume of the solution with the arrangement of the switching means, can also be mentioned. However all these tubular solutions, conceived for power transformers, have a vertical arrangement which does not allow the efficient integration thereof in distribution transformers.

Furthermore, the Bulgarian patent BG62108 B1 describes an on-load tap changer (OLTC) voltage side of the transformer assembly comprising mounted on a side opening of the transformer tank insulation board on which are stacked circular contact components of the selection of three phases to them.

On the other hand, the U.S. patent application US1863392A describes an electric switch including a shaft, two parallel spaced conductive plates supported on said shaft, means for rotating said plates alternately about said shaft, a movable contact secured to each plate, fixed contacts supported in the paths of said movable contacts, and a fixed contact supported in contact with each of said plates.

In order to check the position in which the tap changer device is located, i.e., in order to verify if the tap changer device is connected with the suitable tap, an inspection window means is conventionally provided. This inspection window means is usually arranged on the upper cover of the high-voltage electrical equipment, being a peep hole, for example, made in said cover, which means that the peep hole must assure tightness of the high-voltage electrical equipment since the latter contains a dielectric fluid. On the other hand, since said peep hole is located on the upper cover of the equipment, sometimes due to the height of the electrical equipment or the arrangement of the low- and high-voltage bushings, it is not possible to look through said peep hole without the aid of some means, such as a ladder, for example, allowing the operator to verify the position of the tap changer device.

Verification of the position in which the tap changer device is located is necessary, for example, when commissioning the high-voltage electrical equipment, or for example in the event of any malfunction in the control panel of the installation making said verification impossible. In this sense, the solution appearing in technical paper SO1-01 of CIRED of May 2014 ("*Regulacijski Distributivni Transformator*", by Sanela Carevic, Mario Bakaric, Branimir Cucic and Martina Mikulic) can be mentioned as an example, since the solution considered therein comprises a peep hole on the upper cover of the high-voltage electrical equipment, the view of which is hindered by the low- and high-voltage bushings of the cover of the transformer.

In order for tap changer devices to be efficient and cost-effective, there must be a minimal number of switching means, as well as a minimal number of taps, and there must be a maximal number of transformation ratios obtained, without this entailing a significant variation in the constructive arrangement of the transformer.

On the other hand, cold startup of the high-voltage electrical equipment, such as transformers, for example, involves a particularly serious problem in extreme climates in which the dielectric fluid may even solidify, impeding the correct switching of the on-load tap changer device and putting the integrity of the high-voltage electrical equipment at risk. Auxiliary means outside the high-voltage electrical equipment are normally used in these cases so that the dielectric fluid reaches a minimum operating temperature necessary for correct operation of the on-load tap changer device.

DESCRIPTION OF THE INVENTION

The present invention solves the drawbacks mentioned above by providing a "three-phase" or "single-phase" on-load tap changer device envisaged for being used in high-voltage electrical equipment, such as a distribution transformer, for example, being a compact tap changer device having reduced volume and weight which allows automatic voltage control.

The tap changer device of the present invention is installed inside the transformer tank, immersed in the same dielectric fluid contained in the tank, with the feature that the tap changer device comprises a planar and compact configuration making it possible to be installed both horizontally (below the upper cover of the transformer) and vertically (on one side of the transformer) without changing the constructive arrangement of the transformer, thereby obtaining a transformer with an on-load tap changer having reduced dimensions and weight with respect to the state of the art, reducing the amount of dielectric fluid used, as well as the height of the transformer compared to transformers with an on-load tap changer of the state of the art.

According to the planar and compact configuration of the tap changer device object of the invention, it has been envisaged that the device comprises a first plate and a second plate, both of insulating material, the first plate being attached to the second plate by at least one clamping means which can comprise a screw and a spacer sleeve. Therefore, according to a first embodiment of the invention relating to a "three-phase" tap changer device, in the space comprised between the first plate and the second plate the following is comprised installed:

- at least one switching means per phase, such as a vacuum interrupter, for example, provided with a moving contact and a fixed contact,
- at least one tap per phase, associated with at least one connection point of the primary winding of the distribution transformer,
- one tap selecting means per phase, provided with at least one electrical contact,
- at least one protection element per phase, of the type generally used as voltage peak suppressors, such as a varistor, for example.

The tap changer device of the present invention likewise comprises an actuation element which is also mounted between the mentioned first plate and second plate, such that said actuation element is mechanically linked, as a single part, directly and simultaneously with the switching means and with the tap selecting means, no intermediate element therefore being needed to transmit the action of a motor or an operator in the case of manual operation.

The actuation element is secured to a shaft and comprises an inner contour provided with protuberances, such that the rotation of said shaft makes the inner contour act on the switching means, causing the opening—closing of the latter. It has been envisaged that the switching means can comprise a guide element installed around same, assuring a straight and level travel of the moving contact of the switching means. For the purpose of obtaining a planar and compact tap changer device, it has also been envisaged that the switching means are mounted equidistantly from one another on the horizontal plane, for example at 120° from one another, and furthermore by means of this arrangement of the switching means vibrations or movements caused during the switching of the latter are compensated, increasing mechanical reliability and service life thereof.

In turn, the actuation element comprises an outer contour provided with teeth, said actuation element being able to consist, for example, of a gear wheel, such that the rotation of the mentioned shaft makes the actuation element rotate and makes its cogged outer contour act on the tap selecting means, causing the rotation of the latter.

The electrical contacts of the tap selecting means rotate integrally with the latter, causing the connection—disconnection between these electrical contacts and the taps, which involves the changeover between said taps. The actuation of the switching means and the actuation of the tap selecting means are intrinsically coordinated, such that the changeover between taps is performed with at least one switching means open.

On the other hand, the tap changer device of the present invention comprises an inspection window means which allows viewing its position, i.e., to which tap the device is connected. The difference with respect to the state of the art lies in the fact that said inspection window means is not located on the upper cover of the high-voltage electrical equipment, but is arranged in the actual tap changer device, so there is no chance of having tightness issues and costs for adapting high-voltage electrical equipment to the considered solution are reduced. The sight glass means of the tap changer device likewise allows verifying the position of the latter without the operator having to use any other means, such as a ladder, for example. Likewise, the view of the tap is not hindered by the low- and high-voltage bushings of the cover of the transformer.

Another objective of this invention is to obtain the largest possible number of transformation ratios without varying the constructive arrangement of the transformer, assuring the planar and compact configuration of the tap changer device, using the minimal number of switching means and the minimal number of taps.

This on-load tap changer device further comprises one current-limiting element per phase for the case of an inter-turn short-circuit in the changeover of taps, such as a resistor or a reactor, for example. These current-limiting elements can also be used for limiting the magnetizing current of the high-voltage electrical equipment that is generated when said equipment is energized (several times above the nominal value) by means of insertion of the current-limiting elements during excitation of high-voltage electrical equipment, since the electrodynamic and thermal stresses generated by this magnetizing current can compromise the service life of said high-voltage electrical equipment. Furthermore, magnetizing currents can bring about errors in the actuation of fuses and/or protection relays (which disconnect the transformer), and problems with wave quality.

Therefore, those cases proposing nocturnal disconnection of high-voltage electrical equipment, i.e., solar farms, or disconnection when no energy is being generated, i.e., wind farms, to prevent no-load losses of the mentioned high-voltage electrical equipment, the tap changer device would not only regulate voltage of the grid but it could be used as a device for limiting the magnetizing current of the high-voltage electrical equipment by performing the changeover of taps in the position that involves maximum impedance of the circuit at startup. In the startup position, by means of coordination with the sensor system of the high-voltage electrical equipment, a prior check of the temperature of the dielectric fluid is performed to verify that its temperature is suitable for assuring correct switching of the on-load tap changer device. Otherwise, the startup position is maintained and current-limiting devices, sized for continuous operation, act favoring heating of the dielectric fluid until reaching a minimum operating temperature assuring correct operation of the on-load tap changer device, preventing use of external auxiliary means.

According to a second object of the invention, a "single-phase" on-load tap changer device is described, which is structurally simpler with respect to the "three-phase" case and wherein by means of a single actuation element it is possible to perform the functions of the selecting means existing for the "three-phase" case but which for the "single-phase" case are not necessary. This second case of the "single-phase" tap changer device will be explained in more detail later. A final aspect of the invention relates to high-voltage electrical equipment, such as a distribution transformer, for example, which comprises the tap changer device described above, further comprising a primary winding provided with at least one connection point associated with at least one tap of the tap changer device. The number of turns of the primary winding is variable, such that automatically regulating voltage in a secondary winding of the same high-voltage electrical equipment is allowed.

PREFERRED EMBODIMENT OF THE INVENTION

Several preferred embodiments are described below in relation to the drawings mentioned above, without this limiting or reducing the scope of protection of the present invention.

FIGS. 6*a*, 6*b*, 6*c*, 6*d* and 6*e* show single-line diagrams of the "three-phase" or "single-phase" tap changer device (1, 40) comprising a "resistor" as the current-limiting element (18). This "resistor" is installed in series with at least one switching means (2, 3, 4, 5, 6, 7), such as a vacuum interrupter, for example. The tap changer device (1, 40) further comprises at least one protection element (17) per phase, such as a varistor, for example, installed in parallel to the switching means (2, 3, 4, 5, 6, 7).

Figure 7C:
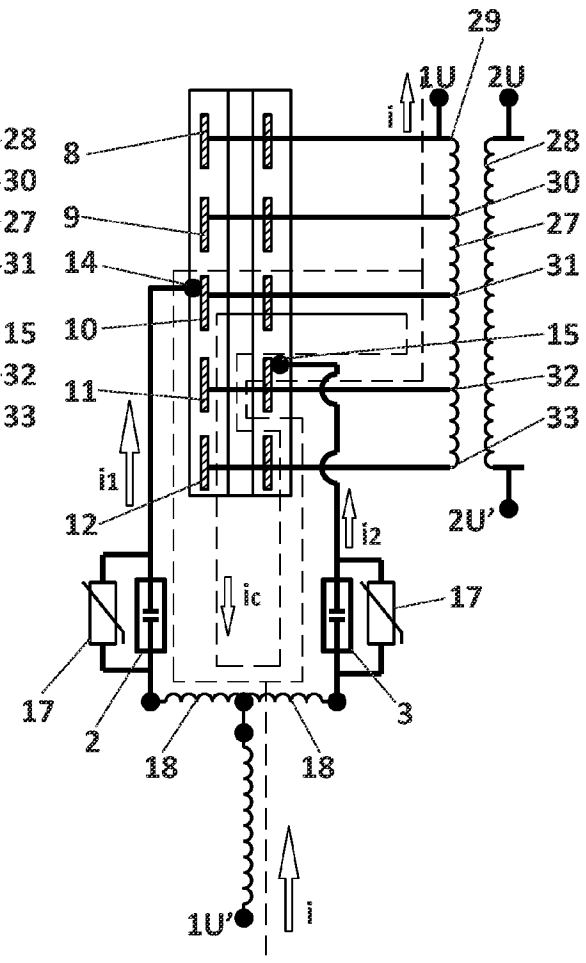
FIGS. 7*a*, 7*b*, 7*c* show three single-line diagrams of a "three-phase" or "single-phase" tap changer device comprising a "reactor" as the current-limiting element, showing the sequence of operations for performing the changeover from one tap to another.
Figure 7B:
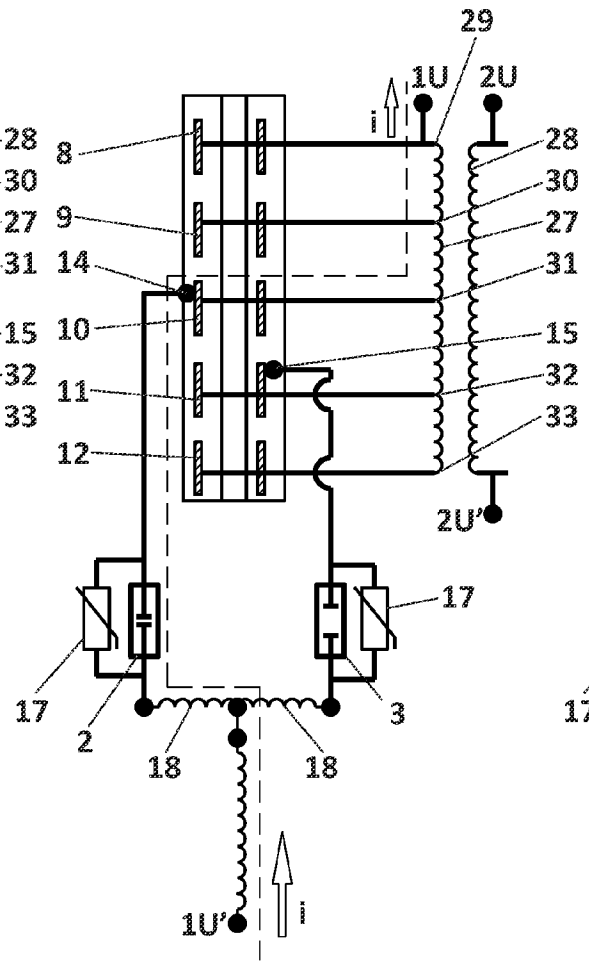
Figure 7A:
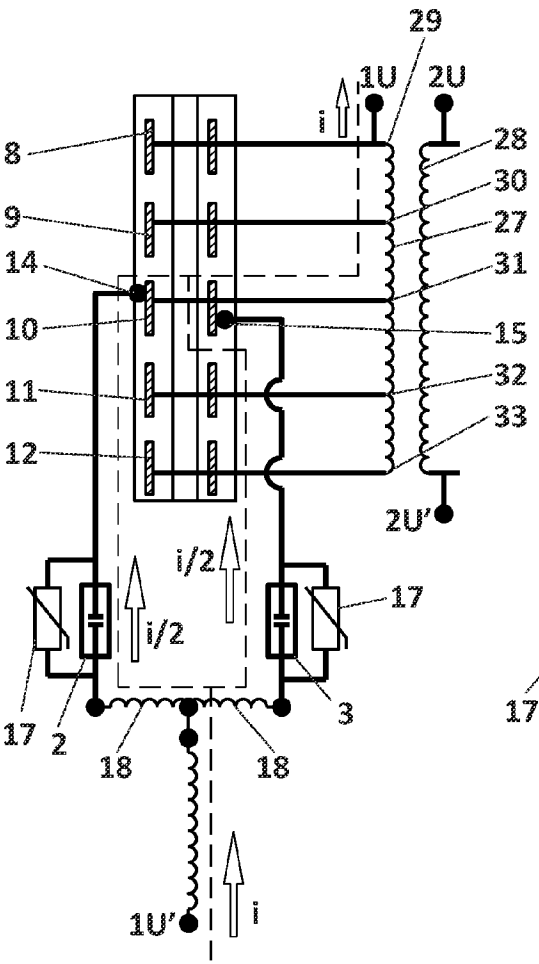

FIGS. 7*a*, 7*b* and 7*c* show single-line diagrams of the "three-phase" or "single-phase" tap changer device (1, 40) comprising a "reactor" as the current-limiting element (18). This "reactor" (18) is installed in series with at least one switching means (2, 3, 4, 5, 6, 7), such as a vacuum interrupter, for example. The tap changer device (1, 40) further comprises at least one protection element (17) per phase, such as a varistor, for example, installed in parallel to the switching means (2, 3, 4, 5, 6, 7).

Figure 3:
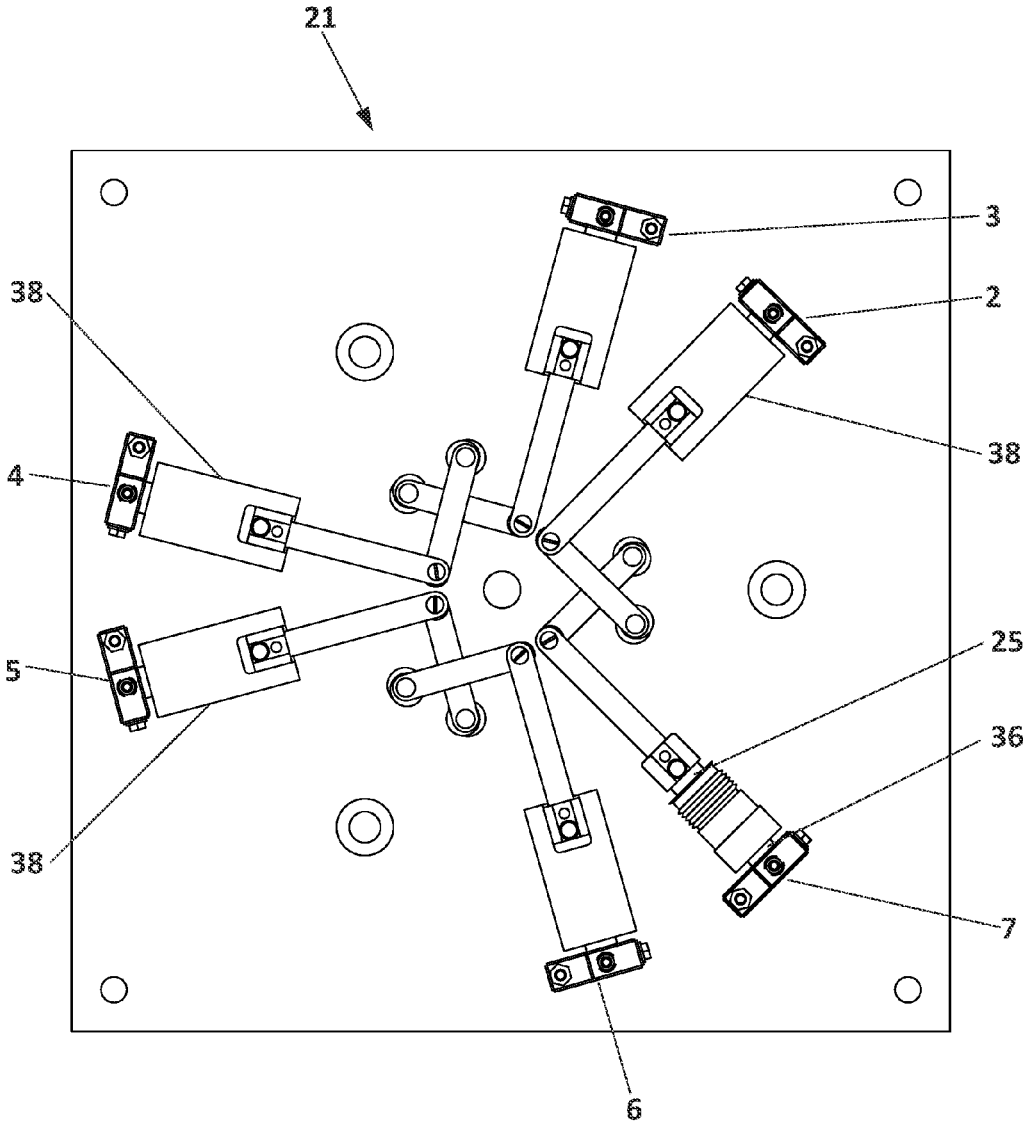
FIG. 3 shows a plan view of the second insulating plate of the "three-phase" tap changer device, where the switching means are mounted.
Figure 4:
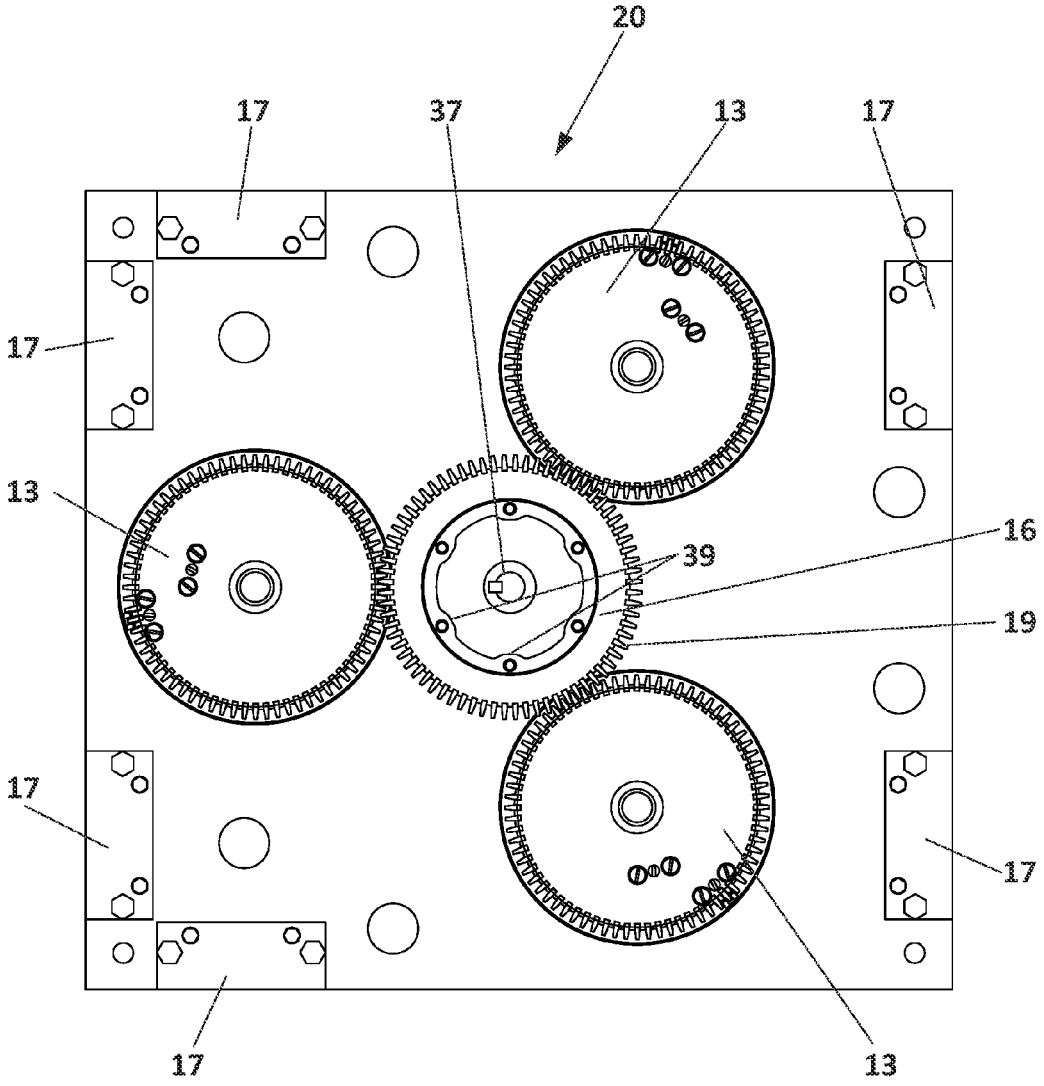
FIG. 4 shows a plan view of the actuation element and the tap selecting means on the first insulating plate of the "three-phase" tap changer device.

The "three-phase" tap changer device (1) depicted in FIGS. 1-4 can be used both with "resistors", and with "reactors". It can be seen in FIG. 2 that the "three-phase" tap changer device (1) comprises at least one tap (8, 9, 10, 11, 12) per phase, mounted on a first insulating plate (20), the mentioned at least one protection element (17) being mounted on the same plate (20). An actuation element (16) and at least one selecting means (13) for selecting said at least one tap (8, 9, 10, 11, 12) are also mounted on this first plate (20), as shown in FIG. 4.

Figure 1:
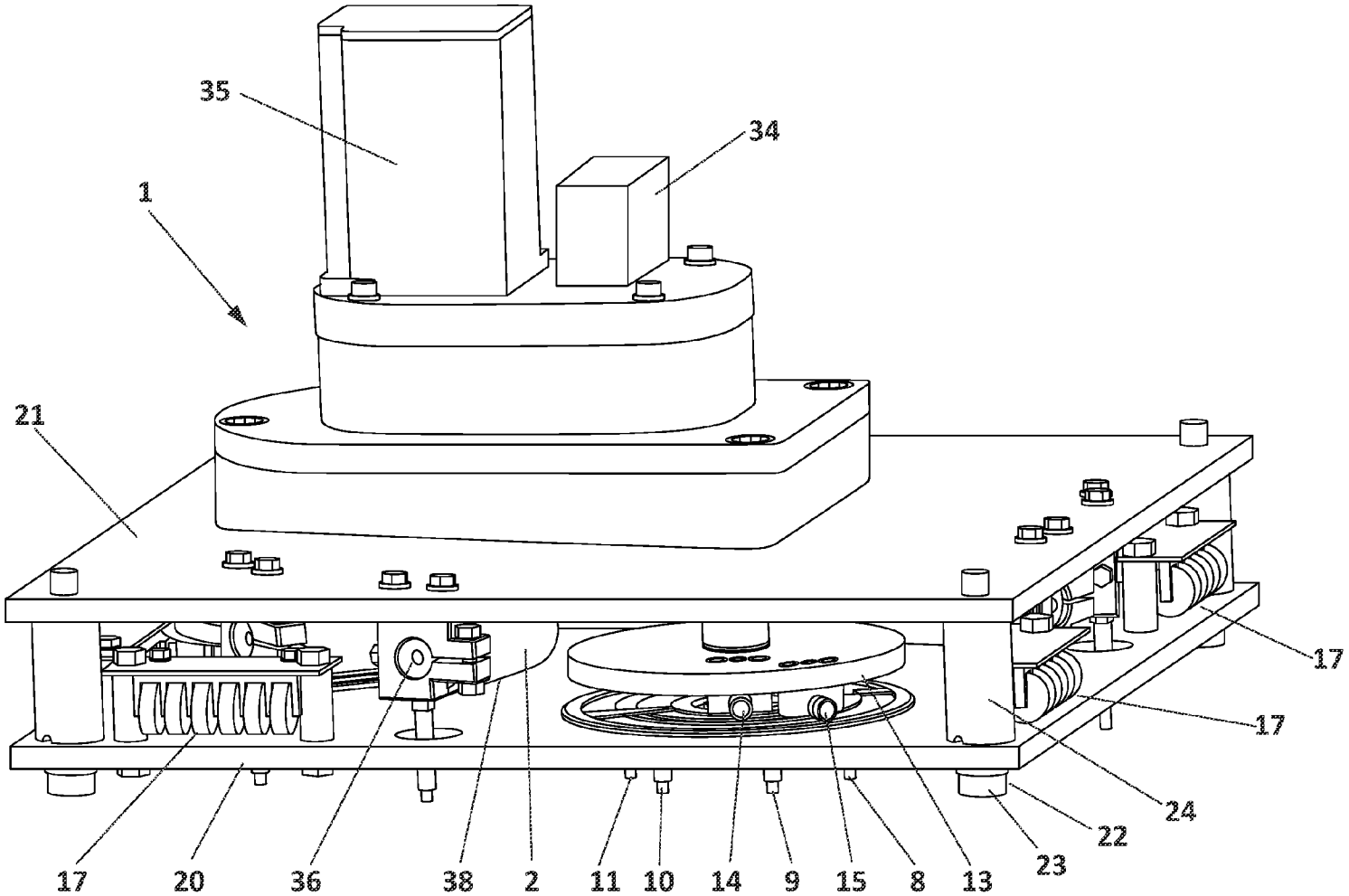
FIG. 1 shows a perspective view of a "three-phase" tap changer device according to the present invention.
Figure 2:
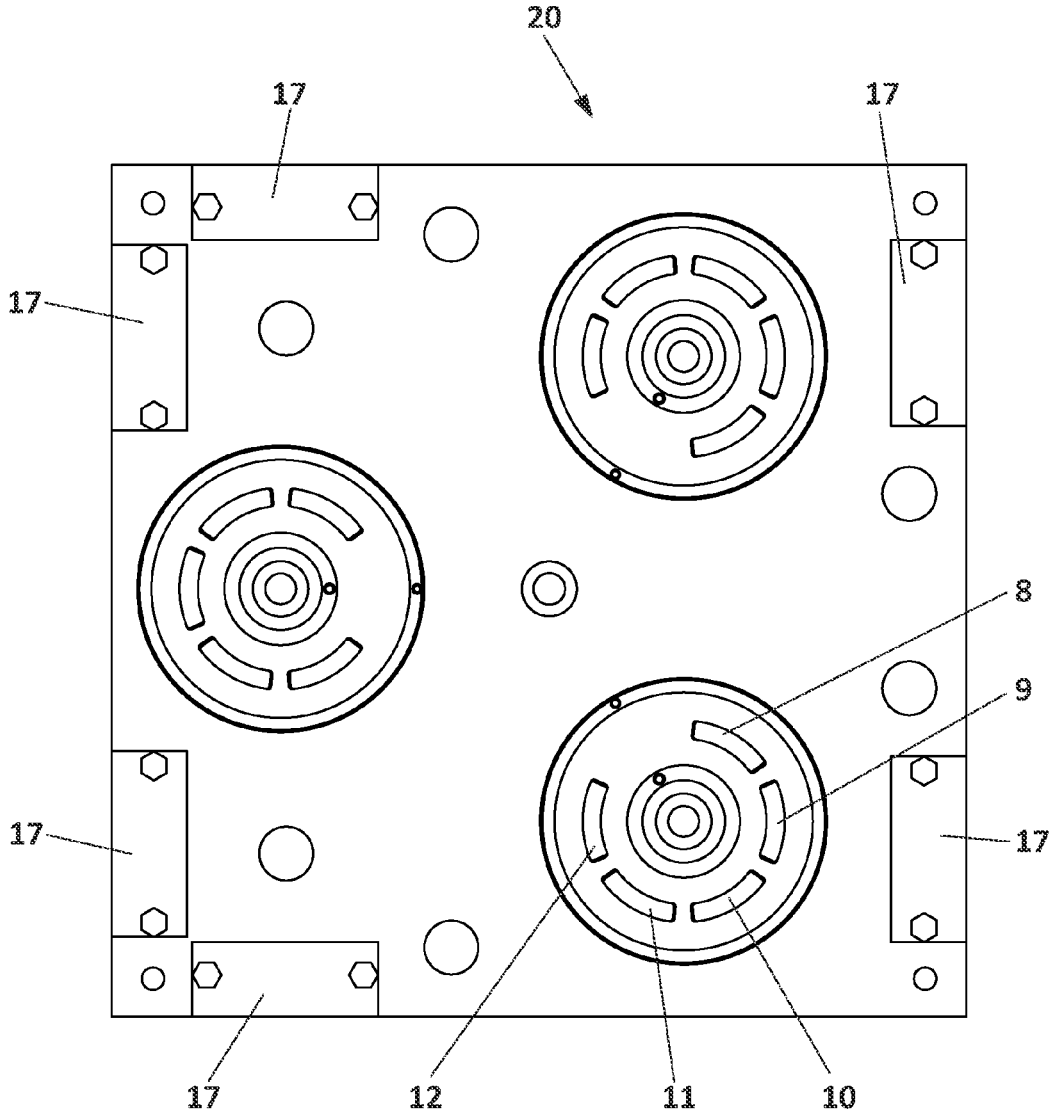
FIG. 2 shows a plan view of the first insulating plate of the "three-phase" tap changer device, where taps and protection elements are mounted.

In FIG. 3 it can be seen that the "three-phase" tap changer device (1) also comprises a second insulating plate (21) where the switching means (2, 3, 4, 5, 6, 7) are mounted. The taps (8, 9, 10, 11, 12), at least one protection element (17) and the switching means (2, 3, 4, 5, 6, 7), as well as the actuation element (16) and at least one selecting means (13), are therefore mounted between both plates (20, 21). Both plates (20, 21) are attached to one another by at least one clamping means (22) comprising a screw (23) and a spacer sleeve (24), as can be seen in FIG. 1. The arrangement of the actuation element (16) and of at least one selecting means (13) allows said actuation element (16) to act, as a single part, directly and simultaneously on the switching means (2, 3, 4, 5, 6, 7) and on at least one selecting means (13).

FIG. 4 shows that the actuation element (16) is secured to a shaft (37) and further comprises an inner contour provided with protuberances (39), such that the rotation of the shaft (37) makes the inner contour act on the switching means (2, 3, 4, 5, 6, 7), causing the opening—closing of the latter. In turn, given that the actuation element (16) comprises an outer contour provided with teeth (19), shown in FIG. 4, the rotation of the shaft (37) makes said outer contour act on the selecting means (13) causing the rotation of the latter.

Figure 5:
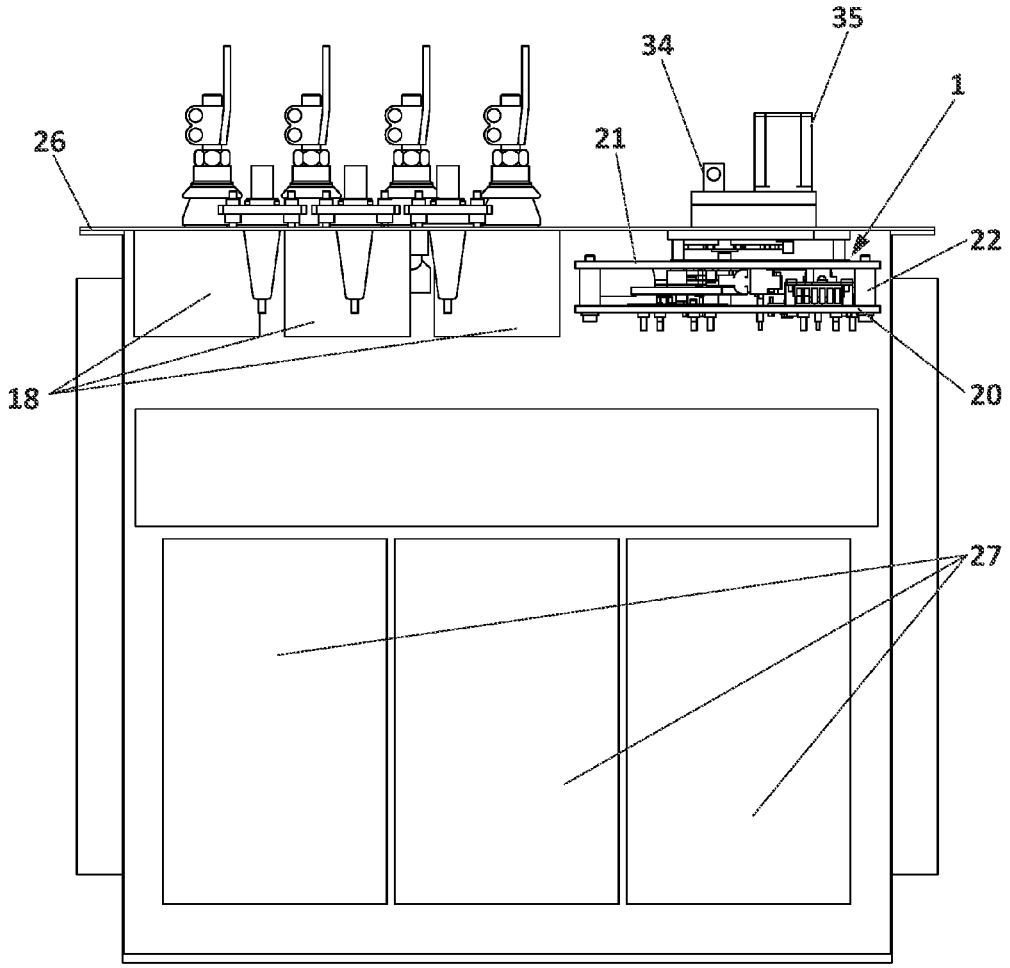
FIG. 5 shows an elevational view of high-voltage electrical equipment with the "three-phase" tap changer device installed therein.
Figures 6A, 6B, 6C:
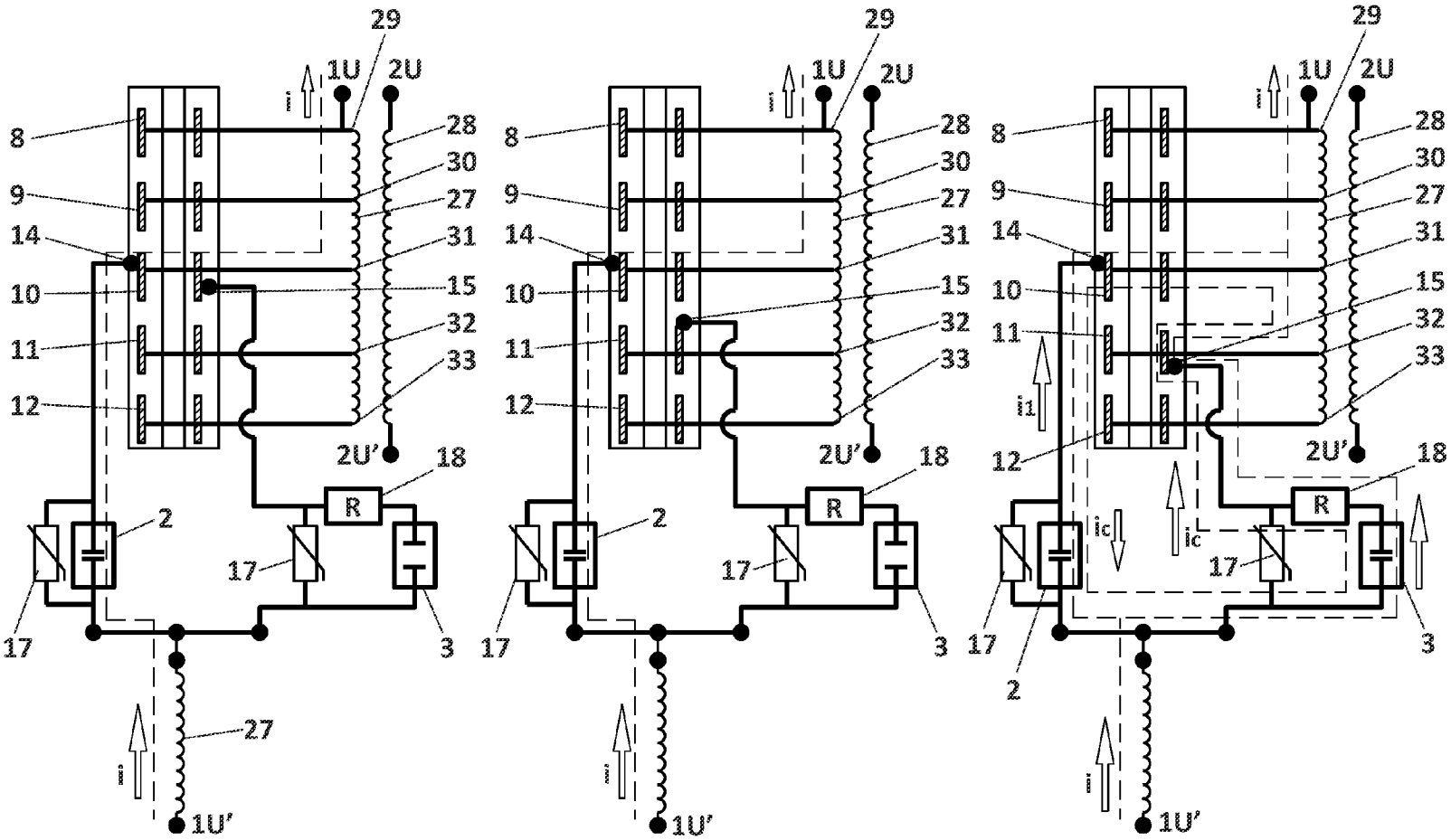
FIGS. 6*a*, 6*b*, 6*c*, 6*d*, 6*e* show five single-line diagrams of a "three-phase" or "single-phase" tap changer device comprising a "resistor" as the current-limiting element, showing the sequence of operations for performing the changeover from one tap to another.
Figure 6E:
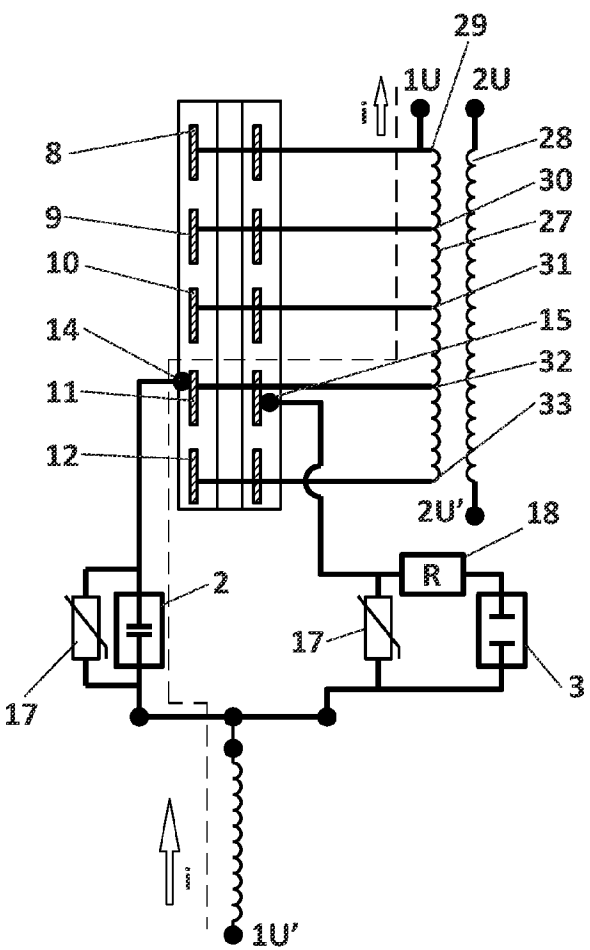
Figure 6D:
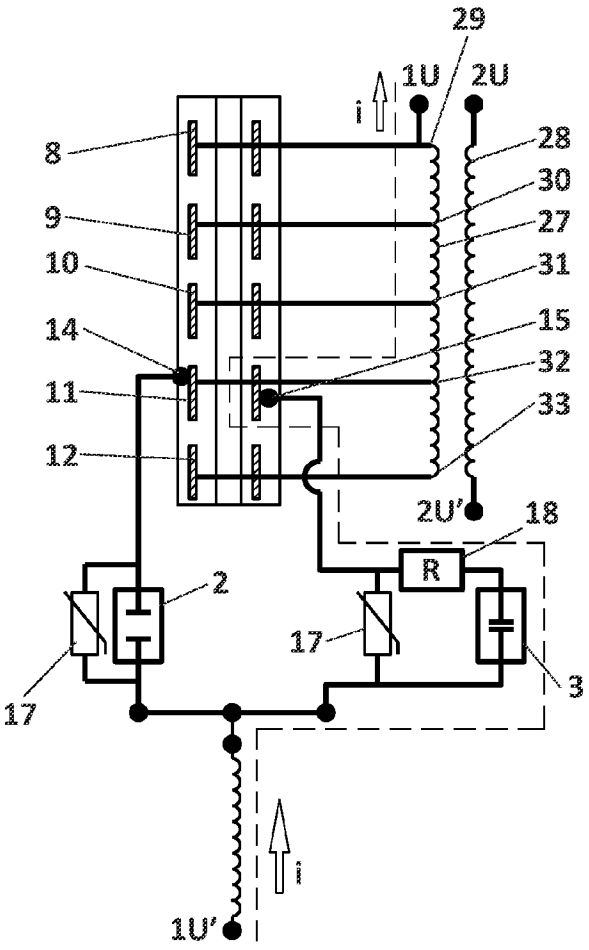

Therefore, the actuation of the switching means (2, 3, 4, 5, 6, 7) and the actuation of the selecting means (13) are intrinsically coordinated, such that the changeover between taps (8, 9, 10, 11, 12) is performed with at least one switching means (2, 3, 4, 5, 6, 7) open. The selecting means (13) comprises at least one electrical contact (14, 15) rotating integrally with said means (13), causing the connection—disconnection between these contacts (14, 15) and the taps (8, 9, 10, 11, 12), which involves the changeover between taps (8, 9, 10, 11, 12). As shown in FIGS. 1 and 5, the actuation element (16) can be moved or its shaft (37) can rotate due to the action of a motor (35), which can be powered by any low-voltage power source, or it can rotate manually due to the action of an operator.

As shown in FIG. 5, the tap changer device (1) comprises an inspection window means (34) which allows verifying to which tap (8, 9, 10, 11, 12) the device (1) is connected. It has likewise been envisaged that the switching means (2, 3, 4, 5, 6, 7) comprising a fixed contact (36) and a moving contact (25) can comprise a guide element (38) installed around same, assuring a straight and level travel of the moving contact (25), regardless of whether the arrangement thereof in high-voltage electrical equipment is vertical or horizontal, as shown in FIG. 3.

FIG. 5 shows the "three-phase" tap changer device (1) installed in high-voltage electrical equipment (26), such as a high-voltage/low-voltage distribution transformer, for example, where the electrical equipment (26) comprises a primary winding (27) provided with at least one connection point (29, 30, 31, 32, 33) associated with at least one tap (8, 9, 10, 11, 12), the number of turns in the primary winding (27) being variable, such that automatically regulating voltage in the secondary winding (28) of the electrical equipment (26) is allowed. The "three-phase" tap changer device (1) is likewise in an arrangement such that it is not affected by current-limiting elements (18), since the tap changer device (1) and the current-limiting element (18) are far enough away from one another in independent locations within the high-voltage electrical equipment (26).

FIGS. 6*a*, 6*b*, 6*c*, 6*d* and 6*e* depict the sequence of operations carried out for performing the changeover from tap (10) to tap (11) for the case in which a "resistor" is used as the current-limiting element (18), for the purpose of increasing voltage in the secondary winding (28) of the high-voltage electrical equipment (26). Starting from tap (10), where switching means (2) is closed and switching means (3) is open, see FIG. 6*a*, electrical contact (15) is connected to tap (11), FIG. 6*b*, and then switching means (3) is closed, see FIG. 6*c*. In this position, the short-circuit current ($i_c$) that is generated is limited by the "resistor" (18). In a following step, shown in FIG. 6*d*, the switching means (2) opens its contacts and the electrical contact (14) is then connected to tap (11). In the following operation, illustrated in FIG. 6*e*, the contacts of switching means (2) are closed and the contacts of switching means (3) are open to prevent Joule effect losses due to the circulation of current through the current-limiting element (18), i.e., the "resistor" in this case.

FIGS. 7*a*, 7*b* and 7*c* depict the sequence of operations carried out for performing the changeover from tap (10) to tap (11) for the case in which a "reactor" is used as the current-limiting element (18), for the purpose of increasing voltage in the secondary winding (28) of the high-voltage electrical equipment (26). Starting from tap (10), where switching means (2, 3) are closed, see FIG. 7*a*, switching means (3) opens its contacts, as shown in FIG. 7*b*, and electrical contact (15) is then connected to tap (11). In a final step, depicted in FIG. 7*c*, switching means (3) closes its contacts, the short-circuit current ($i_c$) being limited by the current-limiting element (18), i.e., the "reactor" in this case, which in turn allows obtaining an intermediate tap as the "reactor" is in a state of permanence until the following changeover of the tap, keeping losses in high-voltage electrical equipment (26) within an admissible range according to the laws in force.

The difference between using "resistors" and using "reactors" as current-limiting elements (18) is that while "n" voltages are obtained in the first case in the secondary winding (28) of the electrical equipment (26), "2n-1" voltages are obtained in the second case in the secondary winding (28) of the electrical equipment (26).

According to a second object of the invention shown in FIGS. 8 to 13, a "single-phase" instead of a "three-phase" on-load tap changer device is described below. Therefore, said "single-phase" tap changer device comprises: at least one switching means (2, 3); at least one tap (8, 9, 10, 11, 12); at least one protection element (17); and at least one current-limiting element (18).

In addition, the "single-phase" tap changer device comprises a first plate (20) of insulating material and a second plate (21) also of insulating material; an actuation element (48) preferably having rotational movement, mounted between both plates (20, 21), wherein said actuation element (48) in turn comprises at least one electrical contact (49, 50); the actuation element (48) being mechanically linked, as a single part, directly with the switching means (2, 3) and electrically linked with at least one tap (8, 9, 10, 11, 12) through at least one electrical contact (49, 50).

Figure 8:
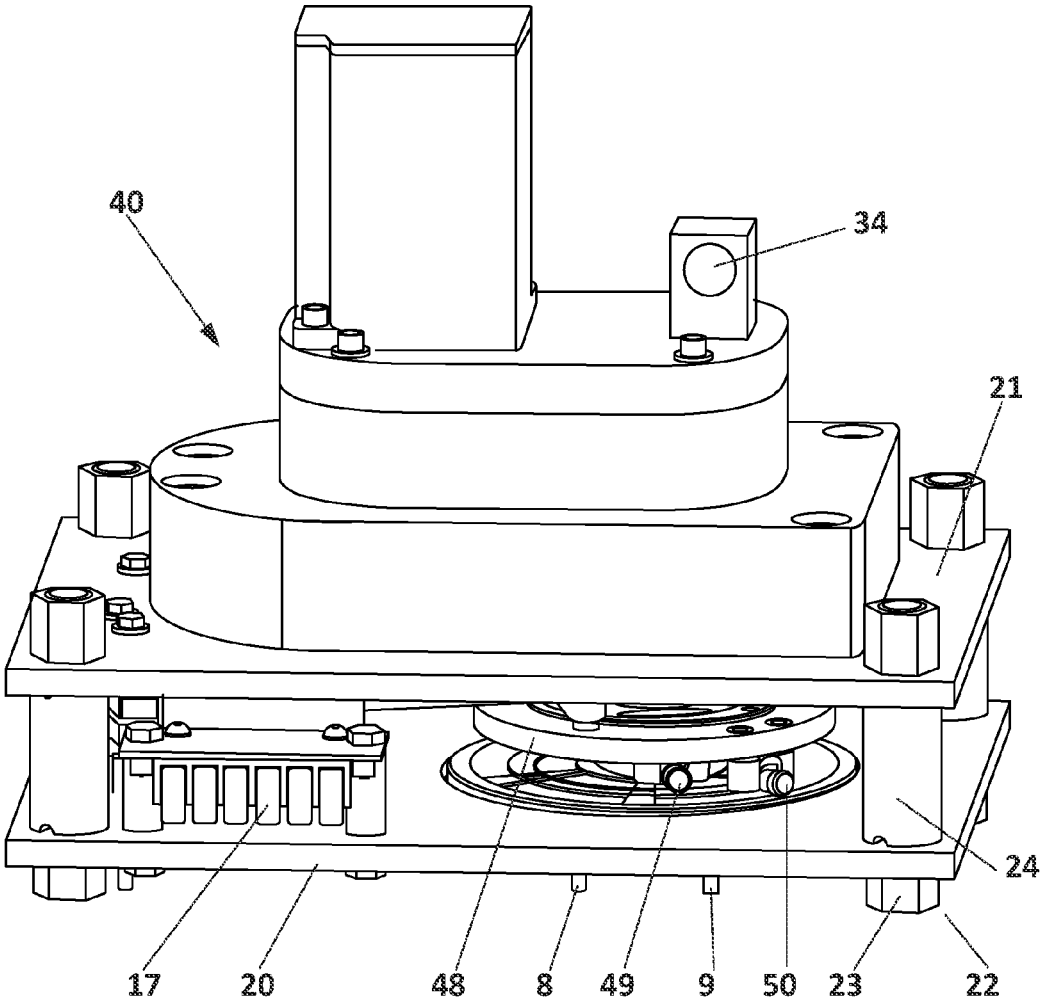
FIG. 8 shows a perspective view of a "single-phase" tap changer device according to the present invention.
Figure 11:
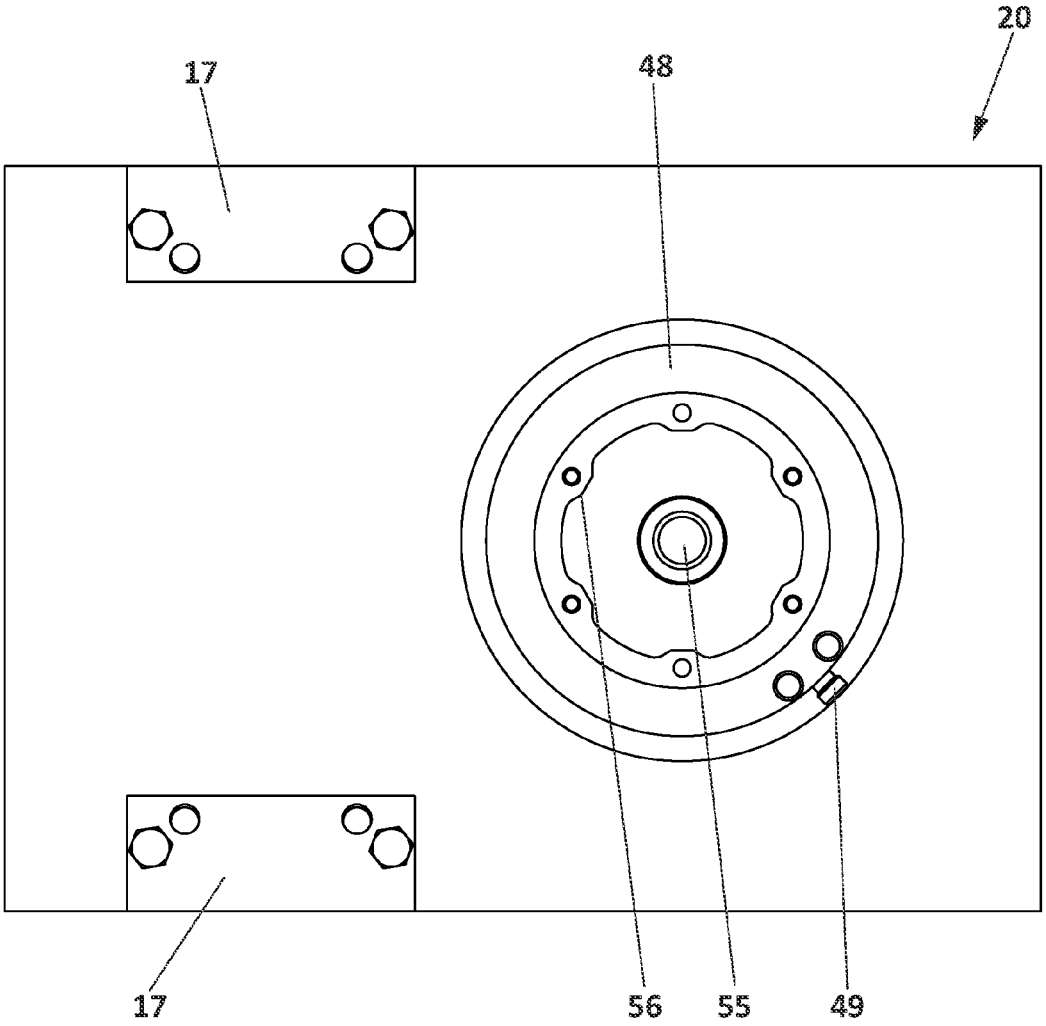
FIG. 11 shows a plan view of the actuation element on the first insulating plate according to a first preferred embodiment of the "single-phase" tap changer device.
Figure 12:
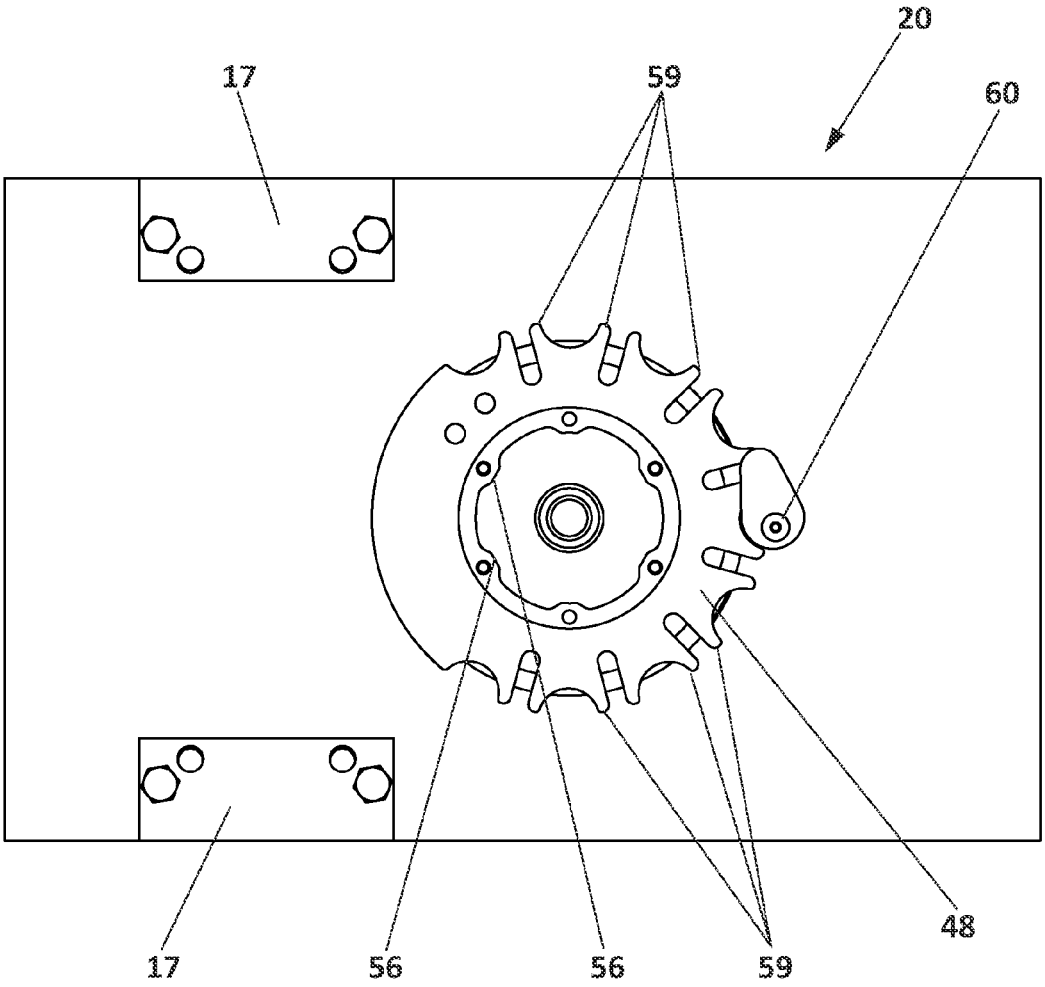
FIG. 12 shows a plan view of the actuation element on the first insulating plate according to a second preferred embodiment of the "single-phase" tap changer device.

Therefore, a simpler structure of the tap changer device is obtained in this single-phase configuration in that that the three selecting means (13) seen in FIG. 4 for the "three-phase" case are not required, and where, in the single-phase configuration, by means of a single actuation element (48), shown in FIGS. 8, 11 and 12, it is possible to perform the functions of said selecting means (13) existing in the "three-phase".

Preferably, as shown in FIG. 8, the at least one protection element (17) is mounted between the first plate (20) and the second plate (21). It should be highlighted at this point that said protection element (17) comprises at least one varistor, while the current-limiting element (18) comprises a "resistor" or a "reactor".

As shown in FIG. 11, the actuation element (48) is secured to a shaft (55) and comprises an inner contour provided with protuberances (56), such that the rotation of the shaft (55) makes the inner contour act on the switching means (2, 3) causing the opening—closing of the latter.

On the other hand, in the view shown in FIG. 12 it can be observed that the actuation element (48) comprises an inner contour provided with protuberances (56), and an outer contour provided with teeth (59), the outer contour being mechanically linked with a transmission shaft (60), such that that the rotation of the transmission shaft (60) makes the inner contour act on the switching means (2, 3) causing the opening—closing of the latter.

Figure 10:
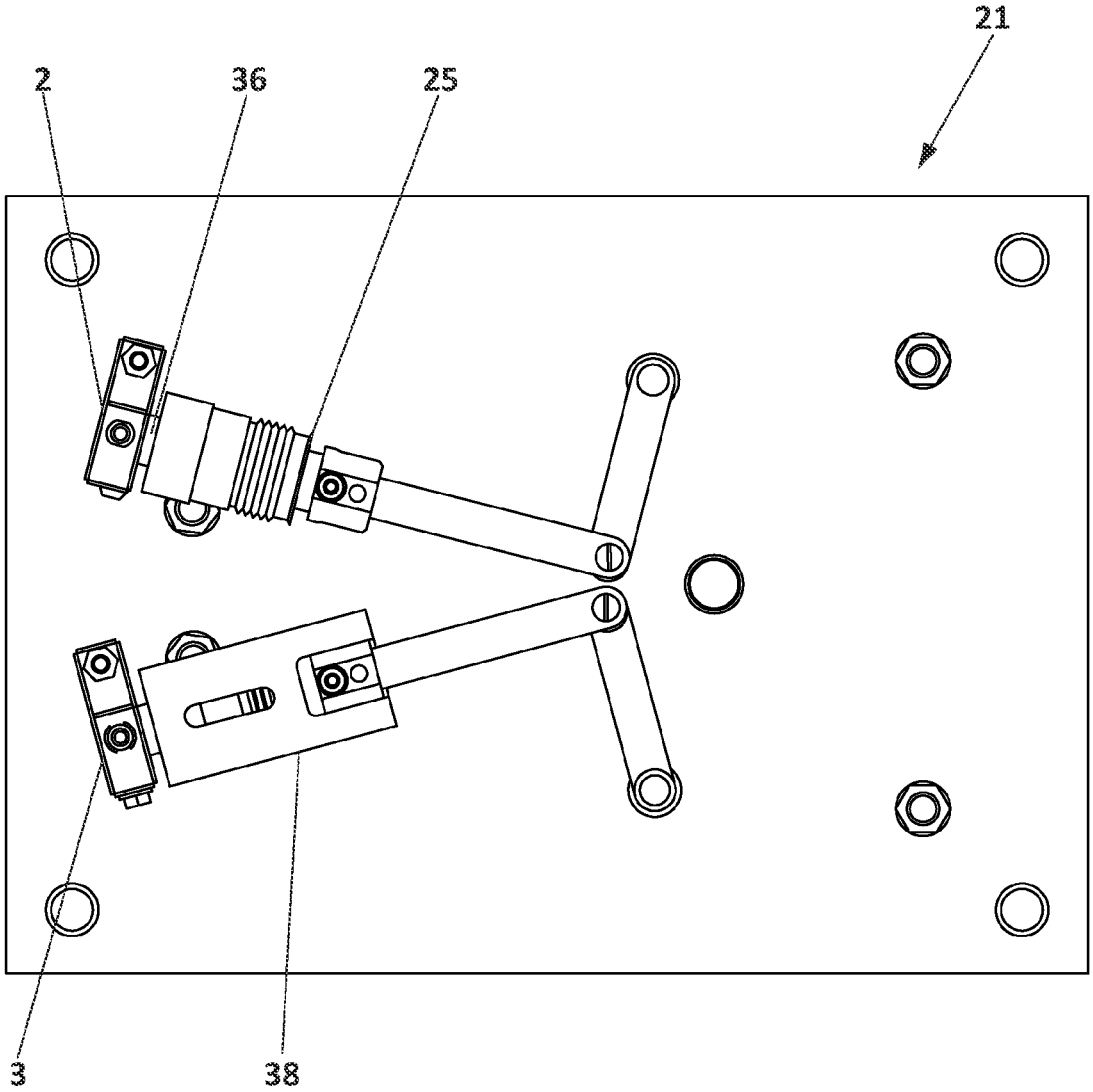
FIG. 10 shows a plan view of the second insulating plate of the "single-phase" tap changer device, where the switching means are mounted.

Similarly to the "three-phase" case, the switching means (2, 3) comprises a moving contact (25) and a fixed contact (36), wherein said switching means (2, 3) further comprises a guide element (38) installed around same, shown in FIG. 10, and assuring a straight and level travel of the moving contact (25) of the switching means (2, 3).

In relation to the electrical contacts (49, 50) of the actuation element (48), depicted in FIGS. 8 and 11, it has been envisaged that said contacts are mounted integrally to the actuation element (48), causing the connection—disconnection between these electrical contacts (49, 50) and the taps (8, 9, 10, 11, 12), which involves the changeover between said taps (8, 9, 10, 11, 12).

Therefore, the actuation of the switching means (2, 3) and the actuation of the actuation element (48) are intrinsically coordinated, such that the changeover between taps (8, 9, 10, 11, 12) is performed with at least one switching means (2, 3) open.

Figure 9:
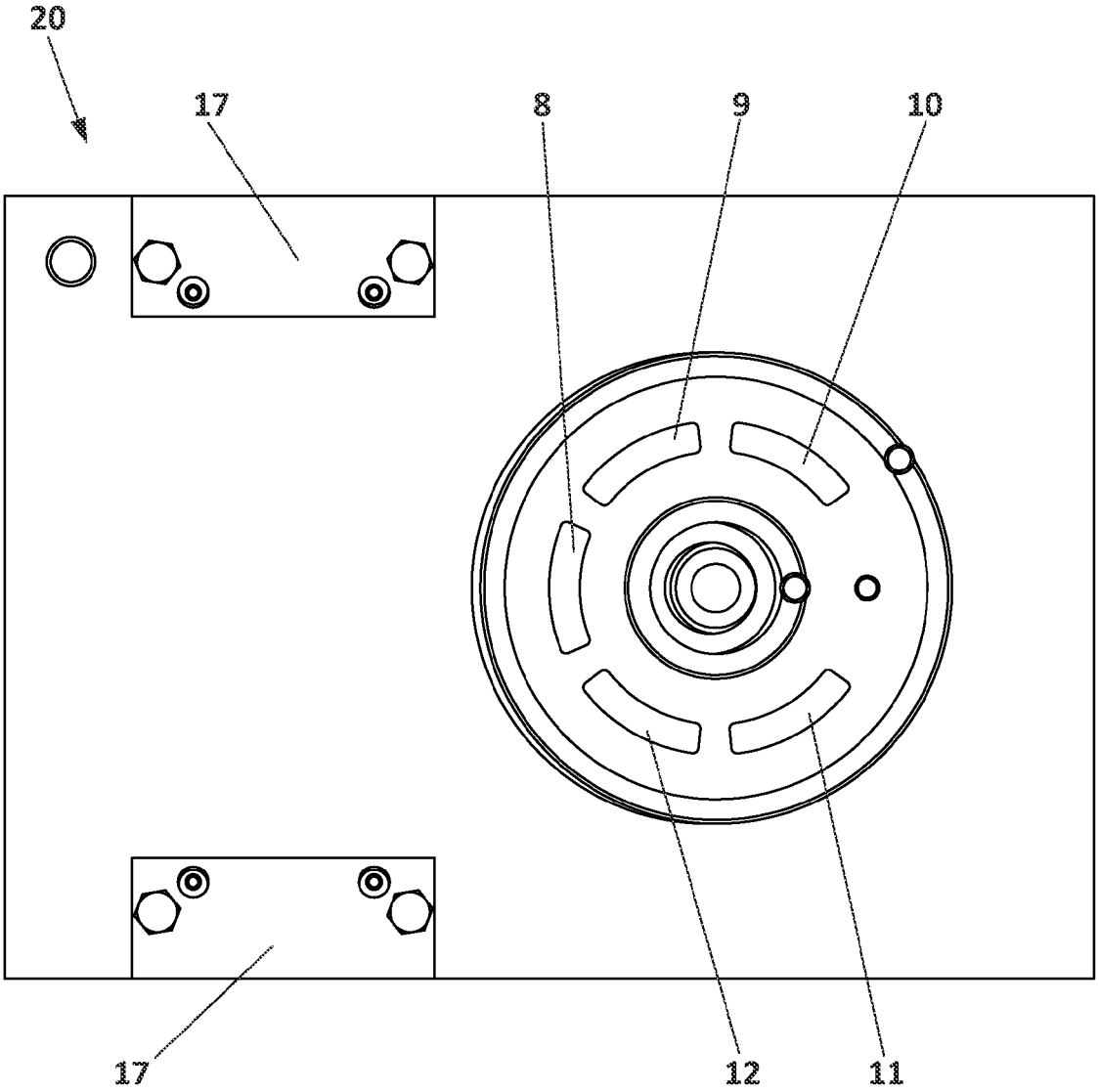
FIG. 9 shows a plan view of the first insulating plate of the "single-phase" tap changer device, where taps and protection elements are mounted.

In FIGS. 9 and 10 it can be seen that the taps (8, 9, 10, 11, 12) are installed on the first plate (20) of insulating material, whereas at least one switching means (2, 3) is installed on the second plate (21) also of insulating material, the taps (8, 9, 10, 11, 12), the switching means (2, 3) and the actuation element (48) thereby being mounted between both plates (20, 21).

As regards the attachment between plates (20, 21), in a similar way as for the "three-phase" case, it has been envisaged that the first plate (20) is attached to the second plate (21) by means of at least one clamping means (22) comprising a screw (23) and a spacer sleeve (24).

Figure 13:
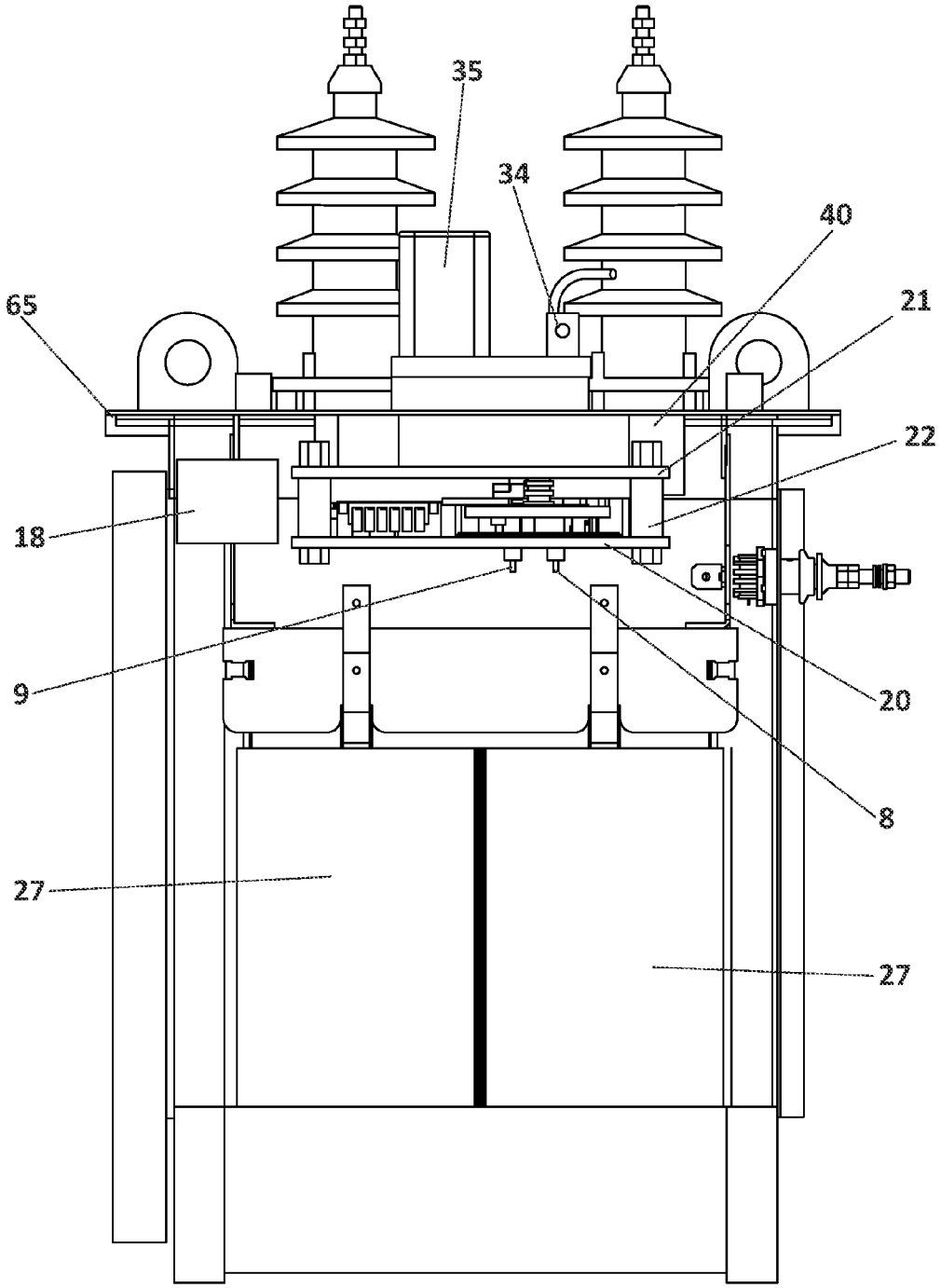
FIG. 13 shows an elevational view of high-voltage electrical equipment with the "single-phase" tap changer device installed therein.

Likewise, the "single-phase" tap changer device (40) comprises an inspection window (34), shown in FIGS. 8 and 13, which allows viewing the position of the "single-phase" tap changer device (40).

On the other hand, FIG. 13 depicts high-voltage electrical equipment (65) comprising a "single-phase" on-load tap changer device (40), and additionally comprising a primary winding (27) provided with at least one connection point (29, 30, 31, 32, 33) associated with at least one tap (8, 9, 10, 11, 12), the number of turns in the primary winding (27) being variable, such that automatically regulating voltage in the secondary winding (28) of the electrical equipment (65) is allowed.

It should be indicated at this point that the "single-phase" tap changer device (40) can be housed inside the electrical equipment (65) horizontally, below the upper cover of the electrical equipment (65), or vertically, on one side of said electrical equipment (65).

Also similarly to the "three-phase" case, the "single-phase" tap changer device (40) comprises a startup position in coordination with the sensor system of the high-voltage electrical equipment (65), wherein a prior check of the temperature of the dielectric fluid is performed to verify that its temperature is suitable for correct operation of the "single-phase" on-load tap changer device (40).

Finally, the possibility of the "single-phase" tap changer device (40) being used in high-voltage "single-phase" or "three-phase" electrical equipment (26, 65) has been contemplated, normally using three "single-phase" tap changer devices (40) in the "three-phase" case.

What is claimed is:

1. "Three-phase" on-load tap changer device comprising:
at least one switching means per phase,
at least one tap per phase,
one selecting means per phase for selecting said at least one tap, provided with at least one electrical contact,
one current-limiting element per phase,
a first plate of insulating material,
at least one protection element per phase,
a second plate also of insulating material, and,
an actuation element mounted between both plates, said actuation element being mechanically linked, as a single part, directly and simultaneously with the switching means and with the selecting means
wherein the at least one switching means installed on the second plate and the taps installed on the first plate, the taps, the switching means and the selecting means thereby being mounted between both plates.

2. "Three-phase" tap changer device according to claim 1, wherein the actuation element comprises a rotational movement.

3. "Three-phase" tap changer device according to claim 1, wherein the actuation of the switching means and the actuation of the selecting means are intrinsically coordinated, such that the changeover between taps is performed with at least one switching means open.

4. "Three-phase" tap changer device according to claim 1, characterized in that the protection element comprises at least one varistor and the current-limiting element comprises a "resistor" or a "reactor".

5. "Three-phase" tap changer device according to claim 1, further comprising an inspection window means which allows viewing the position of the tap changer device.

6. "Three-phase" tap changer device according to claim 1, wherein the at least one protection element is mounted between the first plate and the second plate.

7. "Three-phase" tap changer device according to claim 6, wherein the first plate is attached to the second plate by at least one clamping means comprising a screw and a spacer sleeve.

8. High-voltage electrical equipment, comprising:
the "three-phase" on-load tap changer device according to claim 1, and
a primary winding provided with at least one connection point associated with at least one tap,
wherein the number of turns in the primary winding is variable, such that automatically regulating voltage in the secondary winding of the electrical equipment is allowed.

9. High-voltage electrical equipment according to claim 8, wherein the "three-phase" tap changer device can be housed inside the electrical equipment horizontally, below the upper cover of the electrical equipment, or vertically, on one side of said electrical equipment.

10. High-voltage electrical equipment according to claim 9, wherein the "three-phase" tap changer device comprises a startup position in coordination with the sensor system of the high-voltage electrical equipment, and a prior check of the temperature of the dielectric fluid is performed to verify that its temperature is suitable for correct operation of the "three-phase" on-load tap changer device.

11. "Three-phase" tap changer device according to claim 1, wherein the actuation element is secured to a shaft comprises an inner contour provided with protuberances, such that the rotation of the shaft makes the inner contour act on the switching means causing the opening-closing of the latter.

12. "Three-phase" tap changer device according to claim 11, wherein the switching means comprises a moving contact and a fixed contact, and wherein said switching means further comprises a guide element installed around same, assuring a straight and level travel of the moving contact of the switching means.

13. "Three-phase" tap changer device according to claim 11, wherein the actuation element comprises an outer contour provided with teeth, such that the rotation of the shaft makes the outer contour of the actuation element act on the selecting means causing the rotation of the latter.

14. "Three-phase" tap changer device according to claim 13, wherein the electrical contacts of the selecting means are mounted integrally to the latter, causing the connection-disconnection between these contacts and the taps, which involves the changeover between said taps.

15. "Single-phase" tap changer device comprising:
at least one switching means,
at least one tap,
at least one current-limiting element (18),
a first plate of insulating material,
at least one protection element,
a second plate also of insulating material, and
an actuation element mounted between both plates,
wherein said actuation element in turn comprises at least one electrical contact,
said actuation element (48) is mechanically linked, as a single part, directly with the switching means and electrically linked with at least one tap through at least one electrical contact, and
the at least one switching means installed on the second plate and the taps installed on the first plate, the taps, the switching means and the actuation element thereby being mounted between both plates.

16. "Single-phase" tap changer device according to claim 15, wherein the electrical contacts of the actuation element are mounted integrally to the latter, causing the connection-disconnection between these contacts and the taps, which involves the changeover between said taps.

17. "Single-phase" tap changer device according to claim 15, wherein the actuation of the switching means and the actuation of the actuation element are intrinsically coordinated, such that the changeover between taps is performed with at least one switching means open.

18. "Single-phase" tap changer device according to claim 15, wherein the protection element comprises at least one varistor and the current-limiting element comprises a "resistor" or a "reactor".

19. "Single-phase" tap changer device according to claim 15 further comprising an inspection window means which allows viewing the position of the "single-phase" tap changer device.

20. "Single-phase" tap changer device according to claim 15, wherein the at least one protection element is mounted between the first plate and the second plate.

21. "Single-phase" tap changer device according to claim 20, wherein the first plate is attached to the second plate by at least one clamping means comprising a screw and a spacer sleeve.

22. High-voltage electrical equipment, comprising:
a "single-phase" on-load tap changer device described in claim 15, and
a primary winding provided with at least one connection point associated with the at least one tap,
wherein the number of turns in the primary winding is variable, such that automatically regulating voltage in the secondary winding of the electrical equipment is allowed.

23. High-voltage electrical equipment according to claim 22, wherein the "single-phase" tap changer device can be housed inside the electrical equipment horizontally, below the upper cover of the electrical equipment, or vertically, on one side of said electrical equipment.

24. High-voltage electrical equipment according to claim 23, wherein the "single-phase" tap changer device comprises a startup position in coordination with the sensor system of the high-voltage electrical equipment, and a prior check of the temperature of the dielectric fluid is performed to verify that its temperature is suitable for correct operation of the "single-phase" on-load tap changer device.

25. "Single-phase" tap changer device according to claim 15, wherein the actuation element comprises a rotational movement.

26. "Single-phase" tap changer device according to claim 25, wherein the actuation element is secured to a shaft, and comprises an inner contour provided with protuberances, such that the rotation of the shaft makes the inner contour act on the switching means causing the opening-closing of the latter.

27. "Single-phase" tap changer device according to claim 26, wherein the switching means comprises a moving contact and a fixed contact, and
said switching means further comprises a guide element installed around same, assuring a straight and level travel of the moving contact of the switching means.

28. "Single-phase" tap changer device according to claim 25, wherein the actuation element comprises an inner contour provided with protuberances, and an outer contour provided with teeth, the outer contour being mechanically linked with a transmission shaft, such that that the rotation of the transmission shaft makes the inner contour act on the switching means causing the opening-closing of the latter.

29. "Single-phase" tap changer device according to claim 28, wherein the switching means comprises a moving contact and a fixed contact, and wherein said switching means further comprises a guide element installed around same, assuring a straight and level travel of the moving contact of the switching means.

* * * * *